United States Patent [19]

Beirnes

[11] Patent Number: 4,457,110

[45] Date of Patent: Jul. 3, 1984

[54] WINDOW CONVERSION ASSEMBLY

[76] Inventor: James R. Beirnes, P.O. Box 2099, Joliet, Ill. 60436

[21] Appl. No.: 357,161

[22] Filed: Mar. 11, 1982

[51] Int. Cl.[3] ..... E05D 13/00

[52] U.S. Cl. ..... 49/419; 49/422; 49/417

[58] Field of Search ..... 49/419, 430, 434, 422, 49/423, 483, 489, 436, 417

[56] References Cited

U.S. PATENT DOCUMENTS

| | | | |
|---|---|---|---|
| 2,688,165 | 9/1954 | Kinish | 49/422 X |
| 2,869,184 | 1/1959 | Zegers | 49/430 |
| 3,080,023 | 3/1963 | Armstrong | 49/419 |
| 3,328,919 | 7/1967 | Beasley, Jr. et al. | 49/434 |
| 4,304,072 | 12/1981 | Pegg | 49/63 |

FOREIGN PATENT DOCUMENTS

| | | | |
|---|---|---|---|
| 504218 | 4/1939 | United Kingdom | 49/483 |

*Primary Examiner*—Kenneth Downey

*Attorney, Agent, or Firm*—John L. Parker

[57] ABSTRACT

A window conversion assembly is provided for use with a building window frame having a head jamb, opposed side jambs, and a bottom sill, the window assembly including a headpiece for mounting against the head jamb of the frame, a sill piece for mounting against the sill of the frame, with one or both of the headpiece and sill piece being resiliently mounted against the frame for accommodating any out-of-squareness of the frame, side members for mounting against the side jambs of the frame, and upper and lower sash windows for mounting within the headpiece, sill piece and side members to form a completed window assembly. The window assembly features full perimeter weather-stripping, utilizing high leaf weather-strips and corresponding deep receiving grooves in the windows to provide weather seals along the horizontal as well as vertical junctures between the window sashes and frame assembly members.

3 Claims, 19 Drawing Figures

FIG. 13
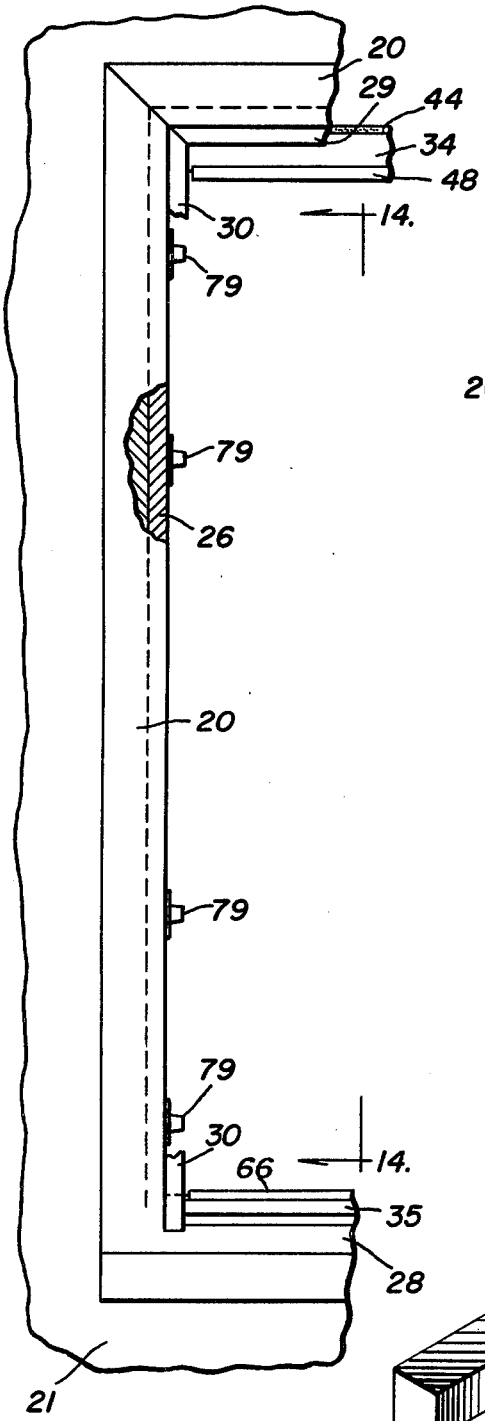
FIG. 14
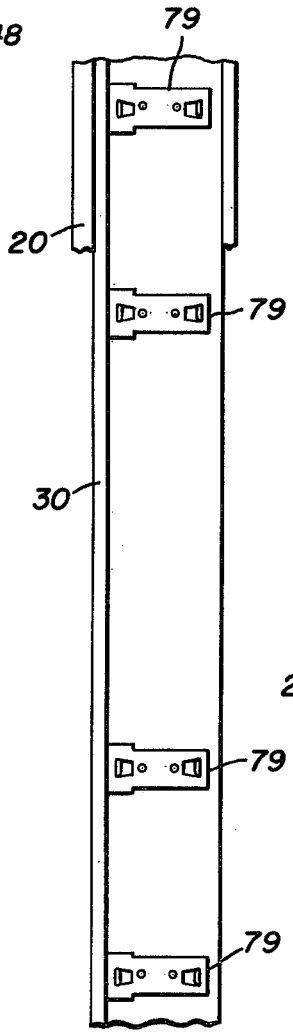
FIG. 15
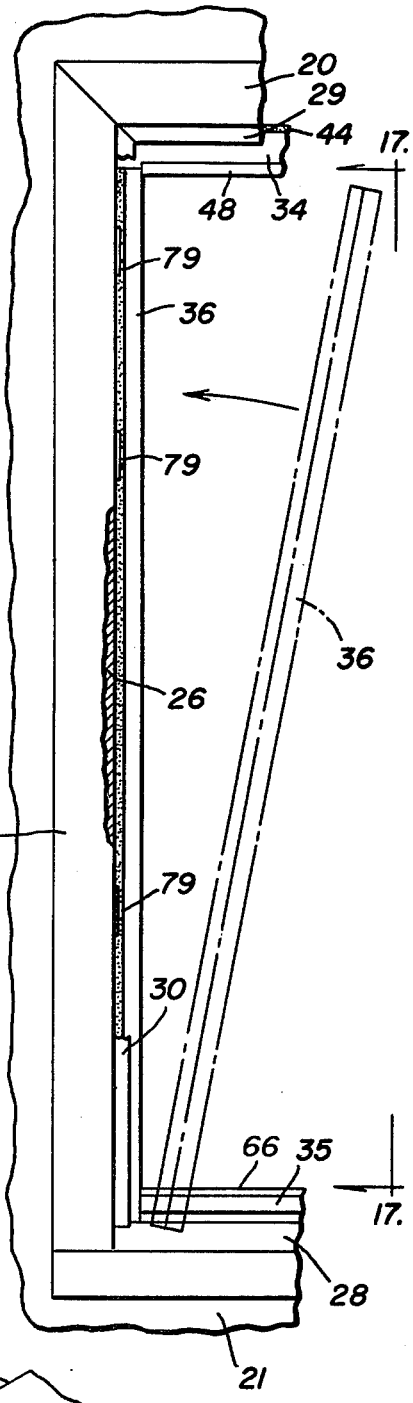
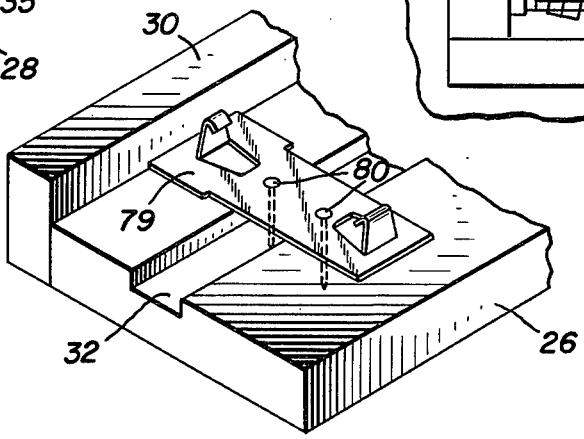
FIG. 16

WINDOW CONVERSION ASSEMBLY

BACKGROUND AND OBJECTS OF THE INVENTION

This invention relates to a conversion assembly for double-hung structural windows. More particularly, the invention relates to an assembly for replacing an old window with a new window without disturbing the frame that holds the windows.

It has been estimated that old windows and doors account for 70% or more of the heating needs of homes and other buildings. Until recently, there has been limited interest in conserving energy by providing fully insulated and weather-stripped doors and windows. Energy costs have increased so much, however, in recent times that it has become essential to keep fuel costs low by providing insulated and weather-stripped windows and doors wherever possible.

Unfortunately, the windows and doors in most old buildings are loose-fitting and often not insulated, making them undesirably drafty. New buildings are often provided with fuel efficient windows and doors. However, the costs of construction have risen so in recent years that it often is more feasible to remodel an old building structure, including the windows and doors, than to erect a new structure. Thus, with home building costs so high, many homeowners find that the most effective use of their funds is by way of rehabilitating and remodeling an existing facility rather than building a new one.

A primary object of the invention is to provide a window conversion assembly, in kit form, for use in replacing and old window with a new one without disturbing the window frame. An allied object of the invention is to provide such an assembly which facilitates replacement of old drafty windows with new insulated windows having a compression fit to the window frame, full insulation including thermal insulating glass, and multiple weather-stripping.

Another object of the present invention is to provide an assembly for converting an old window to a new window with a minimum of physical effort and expense. To this end, it is an object of the invention to provide such a window conversion assembly which may be simply and easily used, by only a single person, to replace an old window with a new one. Still another object of the invention is to provide a window conversion assembly which provides a new window having full perimeter weather-stripping, including in the horizontal as well as vertical planes, a feat which has been difficult to accomplish in the past. Still another object of the invention is to provide such a window conversion assembly which is adaptable for use with old window frames even though they may be worn and/or out-of-square.

BRIEF DESCRIPTION OF THE DRAWINGS

The foregoing and other objects, advantages and functions of the invention will be apparent on reference to the specification and to the attached drawings illustrating a preferred embodiment of the invention, in which drawings like reference symbols are applied to like parts in each of the views, and in which:

FIG. 13 is an enlarged, fragmentary elevational view of one side portion of the window frame of FIG. 2, after installation of the illustrative headpiece and sill piece, and after installation of illustrative mounting clips on the inner sides of the window frame.

FIG. 14 is a fragmentary, elevational view of the inner side of the window frame, with mounting clips installed, taken along the line 14—14 in FIG. 13.

FIG. 15 is an enlarged, fragmentary elevational view of one side portion of the window frame, like FIG. 12 except that an illustrative assembly side member used in carrying out the invention is shown in place (and, in phantom, being swung into place).

FIG. 16 is a fragmentary, enlarged perspective view of the side portion of the window frame, showing an illustrative clip used for mounting each assembly side member to the window frame;

DESCRIPTION OF THE PREFERRED EMBODIMENT

Figure 1:
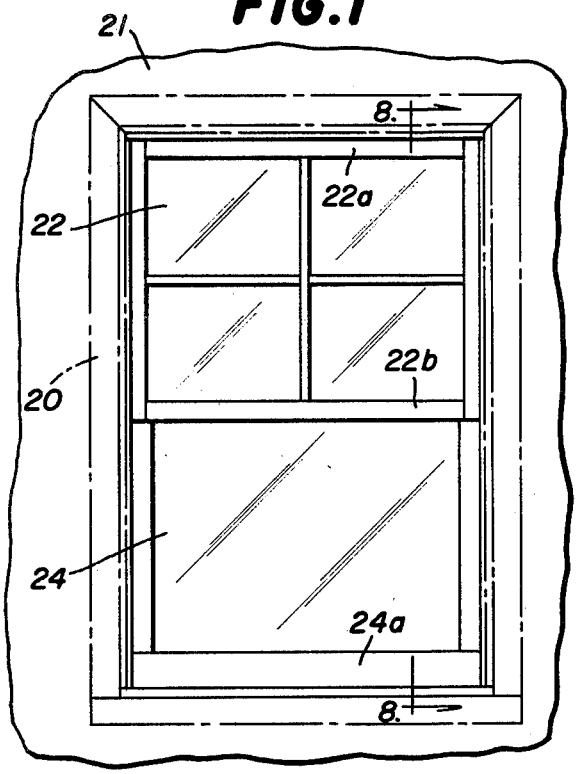
FIG. 1 is an elevational view, from the exterior of a building, of an illustrative double-hung window conversion assembly incorporating the features of the invention, with the old or existing window frame being shown in phantom.

Referring to the drawings, a preferred embodiment of the invention is illustrated in conjunction with an existing window frame 20 disposed in a building wall 21, and in which a double-hung structural window consisting of upper and lower sashes 22 and 24, respectively, is mounted. The illustrative structural window frame 20 includes a horizontal head jamb 25, a pair of spaced parallel vertical side jambs 26 at opposite ends of the head jamb, and an outwardly and downwardly inclined inner sill 28 extending horizontally between the lower ends of the side jambs. The frame 20 also includes a horizontal blind stop 29 extending across the frame along the head jamb 25, and a pair of spaced parallel vertical blind stops 39 extending downwardly therefrom along the side jambs 26. The horizontal and vertical blind stops 29 and 30 are elongated strips rectangular in cross section which together with the inner sill 28 define a generally rectangular window opening 31 leading to the interior of an enclosure, such as a dwelling. A conventional parting stop groove 32 may be provided along the inner surfaces of each side jamb 26, and along the inner surface of the sill 28 for accommodating up-and-down movement of conventional upper and lower window sashes (not shown). A sill nosing 33 is mounted on the outer end of the inner sill 28.

Figure 2:
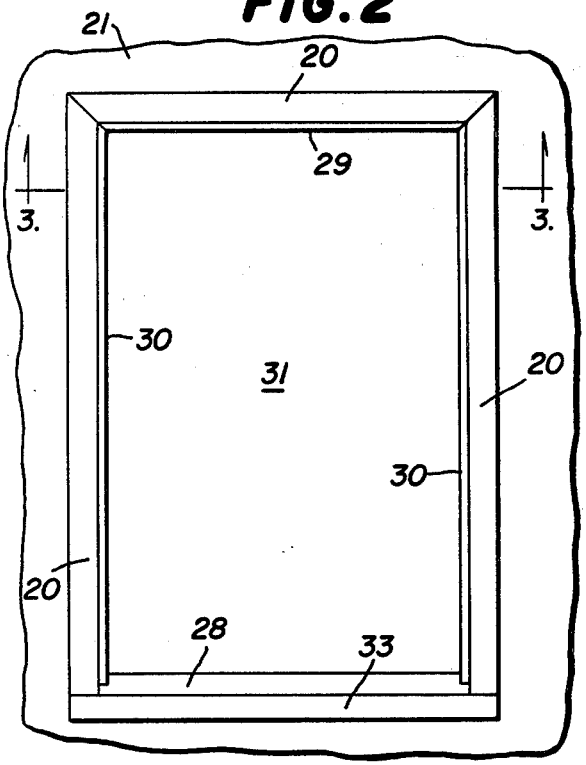
FIG. 2 is a view similar to FIG. 1, showing the existing window frame only (i.e. with the window and related window conversion assembly parts removed).
Figure 3:
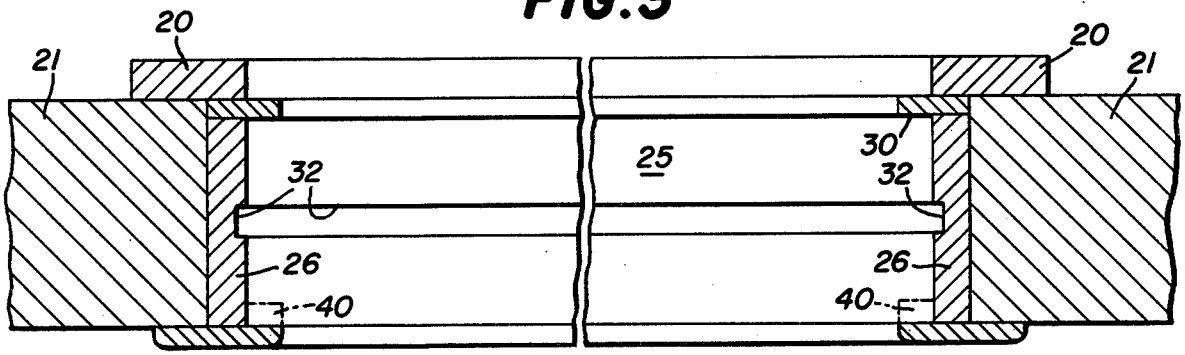
FIG. 3 is a fragmentary, transverse cross-sectional view, taken along line 3—3 in FIG. 2.

To facilitate its description, the invention is described by reference to the steps to be followed in converting an old window to the new window assembly. As indicated, FIG. 2 shows a conventional window frame 20 in which a conventional double-hung window (not shown) is mounted. First, the old window sashes are removed, along with associated parting stops and any existing weather-stripping (also not shown), from the existing window frame 20. In this way, a clean window frame 20 is provided to start. The window conversion assembly of the invention, which is then installed within the frame 20, includes the new upper and lower sash windows 22, 24, a headpiece 34, a sill piece 35, and a pair of side members 36, 38 for mounting the new windows within the frame, along with associated fasteners and clips as will be described below.

After the conventional window sashes have been stripped from the existing window frame 20, the headpiece 34 is installed against the underside of the frame head jamb 25, followed by installation of the sill piece 35 against the frame inner sill 28, and mounting of the side members 36, 38 against the frame side jambs 26. Finally, the new upper and lower sash windows 22, 24 are installed, thus completing the new window assembly 39.

Figure 4:
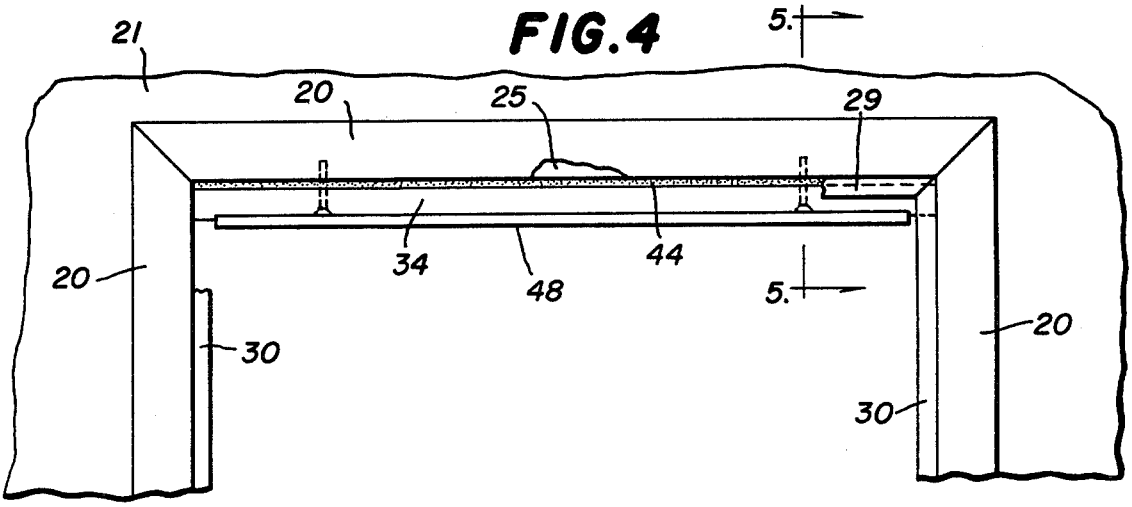
FIG. 4 is an enlarged, fragmentary elevational view of the upper portion of the window frame of FIG. 2, after installation of an illustrative window conversion headpiece used in carrying out the invention.
Figure 5:
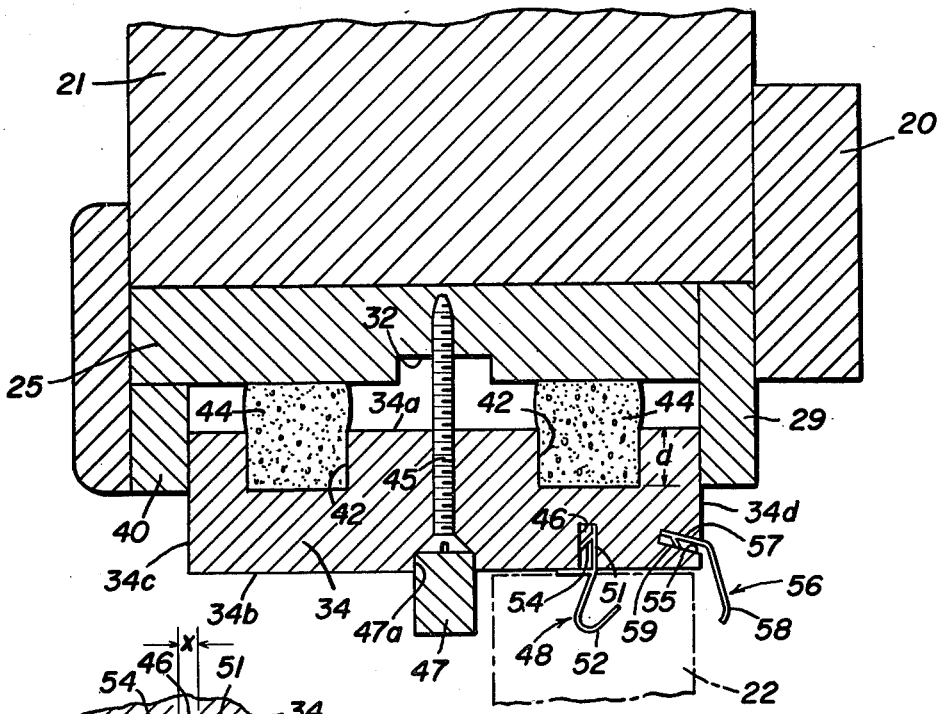
FIG. 5 is a vertical sectional view, taken along the line 5—5 in FIG. 4, showing the details of the illustrative headpiece in place within the upper portion of the window frame.
Figure 6:
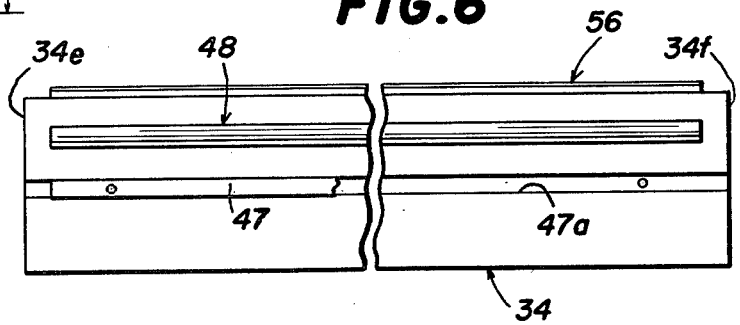
FIGS. 6 and 7 are fragmentary bottom and top plan views, respectively, of the illustrative window conversion headpiece used in carrying out the invention.
Figure 7:
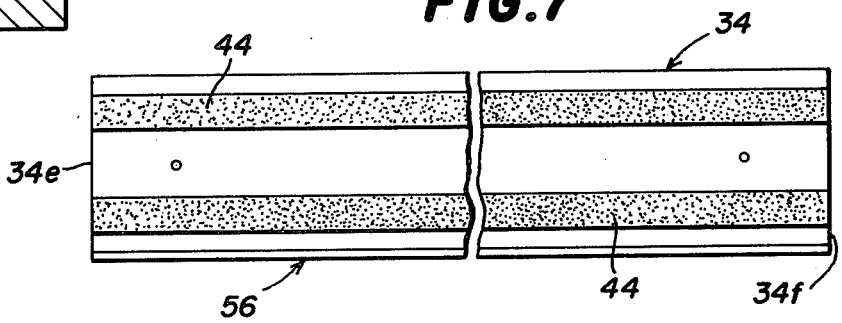

As will be seen particularly from FIGS. 5–7, the illustrative headpiece 34 is of generally flat, rectangular shape and may be formed of wood or like construction material. The headpiece 34 includes flat upper and lower horizontal surfaces 34*a*, 34*b*, respectively, flat vertical edge surfaces 34*c*, 34*d* and flat vertical end surfaces 34*e*, 34*f*. When in place, the edges 34*c*, 34*d* of the headpiece fit neatly between the horizontal blind stop 29 and an internal stop 40 carried by the window frame (see FIG. 5), and the ends 34*e*, 34*f* of the headpiece fit snuggly between the frame side jambs 26 (see FIG. 4).

In keeping with the invention, the upper surface 34*a* of the headpiece is provided with a pair of parallel, spaced longitudinal recesses 42 which carry a corresponding pair of resilient plastic foam pieces 44. The foam pieces 44 are of rectangular solid configuration, and are sized to fit snuggly within the longitudinal recesses 42. The foam pieces 44 have a height which exceeds the depth d of the recesses 42 so that when the headpiece 34 is pressed against the frame head jamb 24, the foam pieces 44 become compressed between the head jamb and the headpiece proper. In this way, a resilient fit between the headpiece 34 and frame 20 is achieved so as to accommodate disposition of the upper window sash 22 to any out-of-squareness of the frame or any variation in the length or height of the frame. The headpiece 34 is secured in place within the frame 20 by means of a plurality of appropriate fasteners 45, which are longitudinally shaped along the headpiece, and which are screwed into the head jamb 25. An elongated wooden strip or parting stop 47 fits in a slot 47*a* provided in the headpiece, covering the fasteners. The parting stop 47 desirably covers any gap between the top horizontal surface of the upper sash 22 and the lower surface 34*b* of the headpiece from view within the building. As shown in FIG. 5, the foam pieces 44 are under compression after the headpiece 34 is tightly in place.

Figure 8:
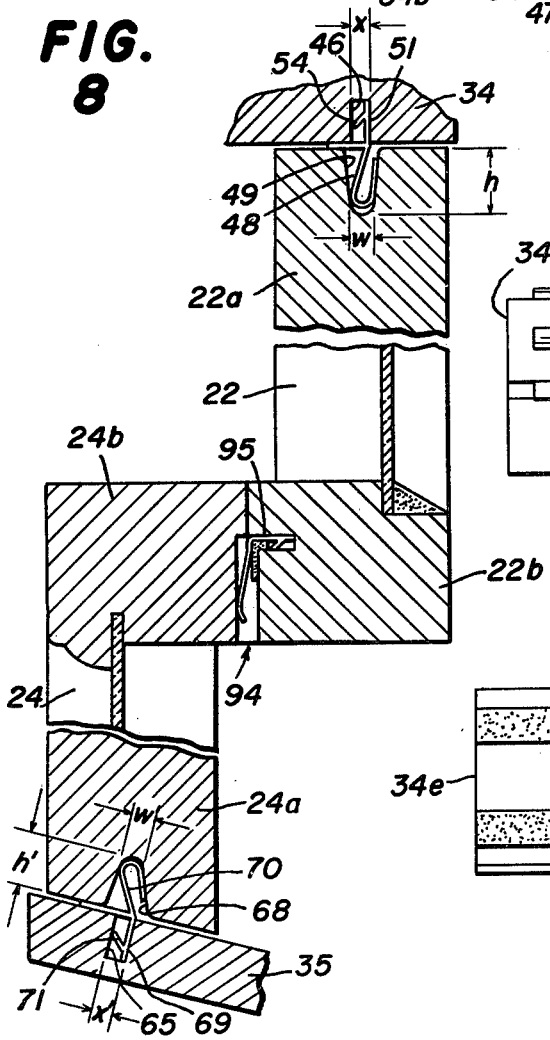
FIG. 8 is a fragmentary, vertical cross-sectional view, taken along the line 8—8 in FIG. 1.

In accordance with one of the features of the invention, the lower surface 34*b* of the headpiece is provided with a longitudinal slot or groove 46 vertically disposed for mounting a specially shaped weather-strip 48 adapted to be received in an open horizontal slot 49 provided along the top surface of the outer rail 22*a* of the new upper window sash 22 (see FIG. 8). The weather-strip 48 includes shank 51 and tongue 52 portions. The shank 51 carries an annular flange 54 sized and shaped so that when the shank of the weather-strip is inserted into the slot 46, the shank fits against one side of the slot and the flange is compressed against the other side of the slot, thus forming a tight friction fit of the shank within the slot. The weather-strip 48 is arranged so that the open side of its tongue 52 faces out-of-doors (i.e., to the right in FIG. 8) to thereby turn the wind back against itself when the tongue has been compressed in a friction fit into the upper window slot 49. In this way, when the upper window sash 22 is in its uppermost position, the weather-strip 48 completely seals the entire length of the horizontal juncture between the upper sash 22 and the headpiece 34, so that no cold or warm air may pass between them.

As will be seen from FIG. 8, the slot 46 provided in the headpiece has a width x, which may be about $\frac{1}{8}$ inch in practice. The upper window slot 49 is slightly V-shaped to facilitate entry therein of the weather-strip tongue 52, having a width w near the bottom where the compressed tongue engages the inner sides of the slot, and a height h. Because of the V-shape, the width of the slot 49 along the upper horizontal surface of the upper window sash 22 is somewhat larger than the width w near the slot bottom. Preferably, the width of the opening of the slot 49 along the upper surface of the window sash 22 is about 1.5 times greater than w, and the slot height h is about 3 to 4 times as large as w. In practice, w may be about $\frac{1}{8}$ inch. In this way, a high leaf type weather-strip 48 with an open tongue or flap 52 may be employed which, when compressed within the slot 49, assures maintenance of sealing contact between the upper window sash 22 and the headpiece 34 even where an extreme out-of-square condition is found to exist in the old window frame.

The outer edge 34*d* of the headpiece is provided with an angularly disposed slot 55 for receiving an exterior weather-strip 56. The exterior weather-strip 56 includes shank 57 and leaf 58 portions. The shank 57 carries an angular flange 59 sized and shaped so that when the shank of the weather-strip is inserted into the slot 55, the shank fits against the upper side of the slot and the flange is compressed against the lower side of the slot, thus forming a tight friction fit of the shank within the slot. The exterior weather-strip thus protects the weatherability of the joint between the upper sash 22 and the headpiece 34.

Figure 9:
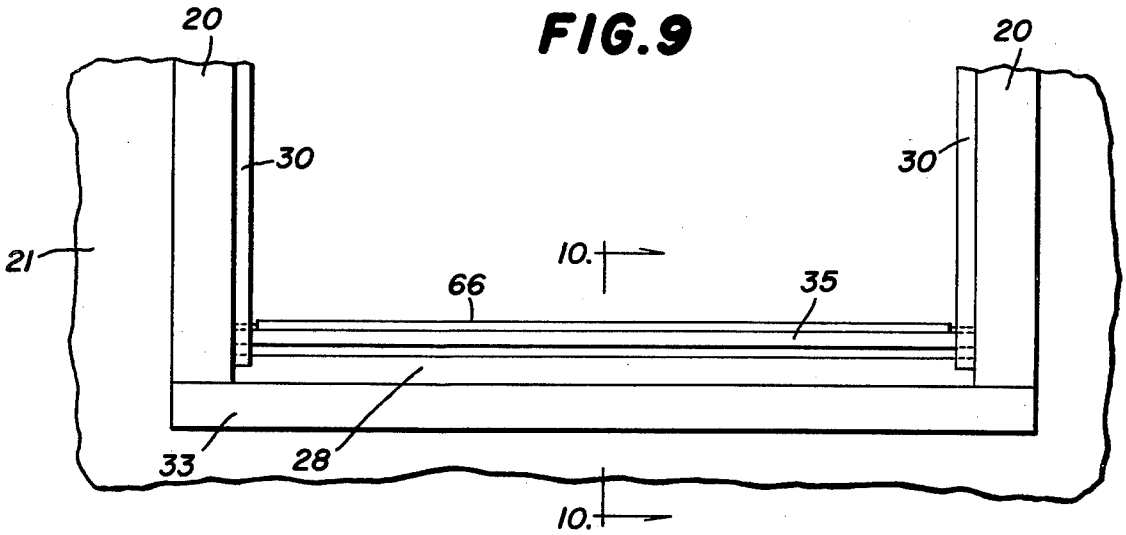
FIG. 9 is an enlarged, fragmentary elevational view of the lower portion of the window frame of FIG. 2, after installation of an illustrative sill piece used in carrying out the invention.
Figure 10:
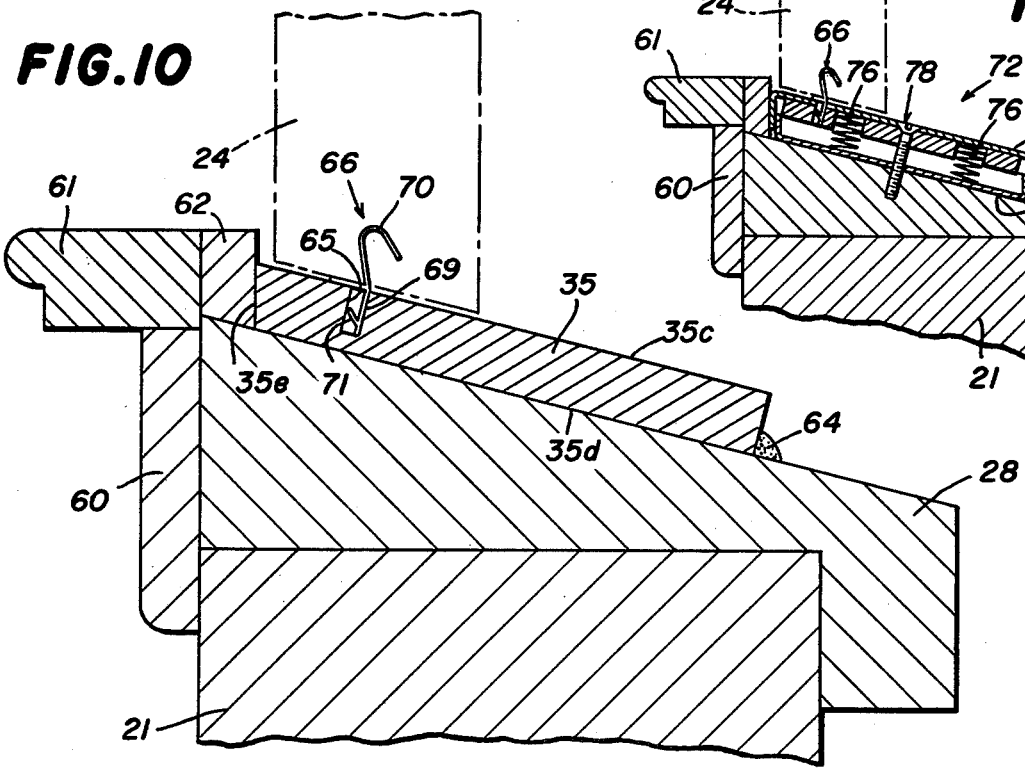
FIG. 10 is an enlarged, fragmentary cross-sectional view, taken along the line 10—10 of FIG. 9.
Figure 12:
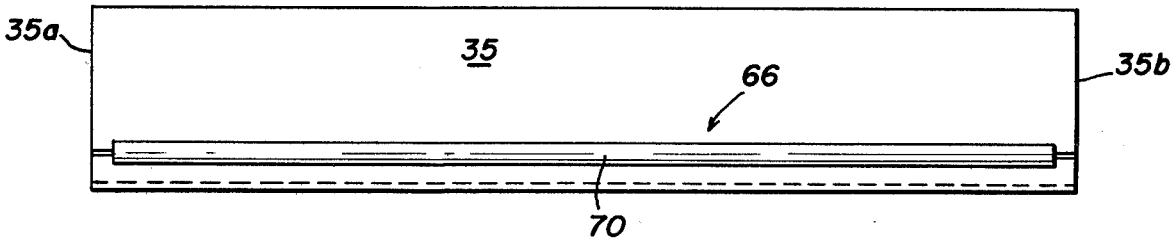
FIG. 12 is a top plan view of the illustrative sill piece shown in FIGS. 9 and 10.
Figure 18:
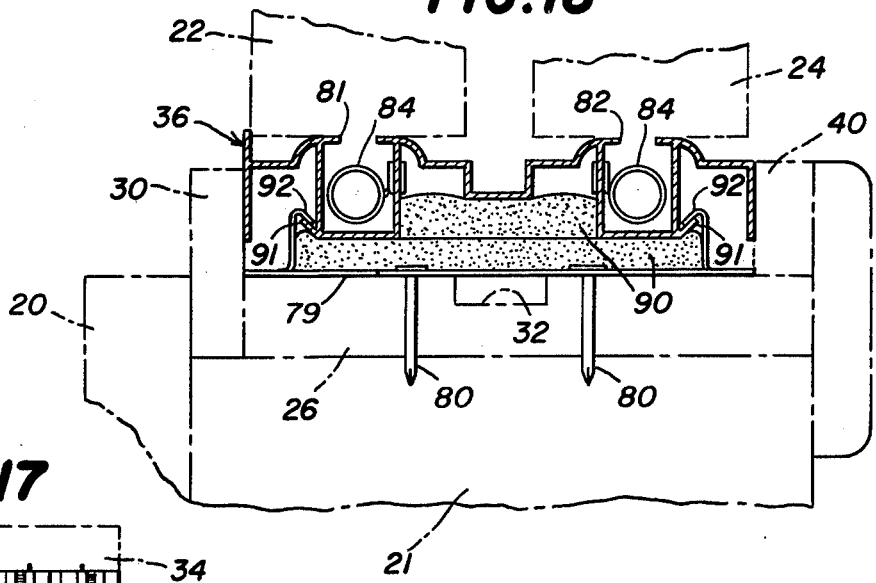
FIG. 18 is a horizontal, cross-sectional view, taken along the line 18—18 of FIG. 17, showing the window sash environment in phantom.
Figure 17:
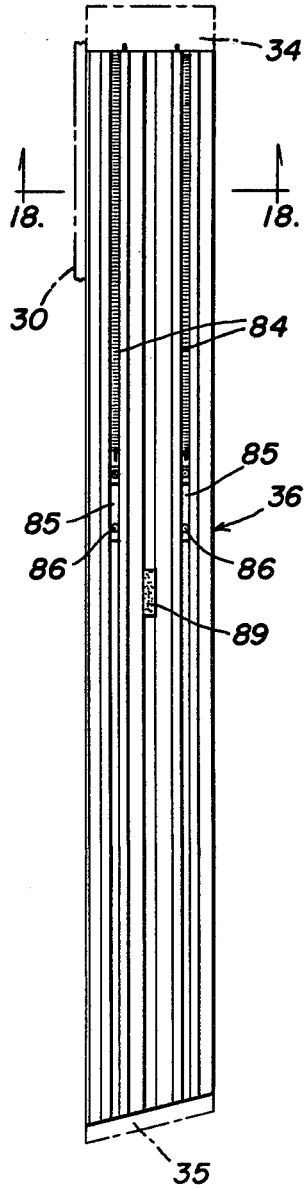
FIG. 17 is a vertical elevational view of one inner side of the window frame (in phantom), after installation of an illustrative assembly side member, taken along the line 17—17 in FIG. 15.
Figure 19:
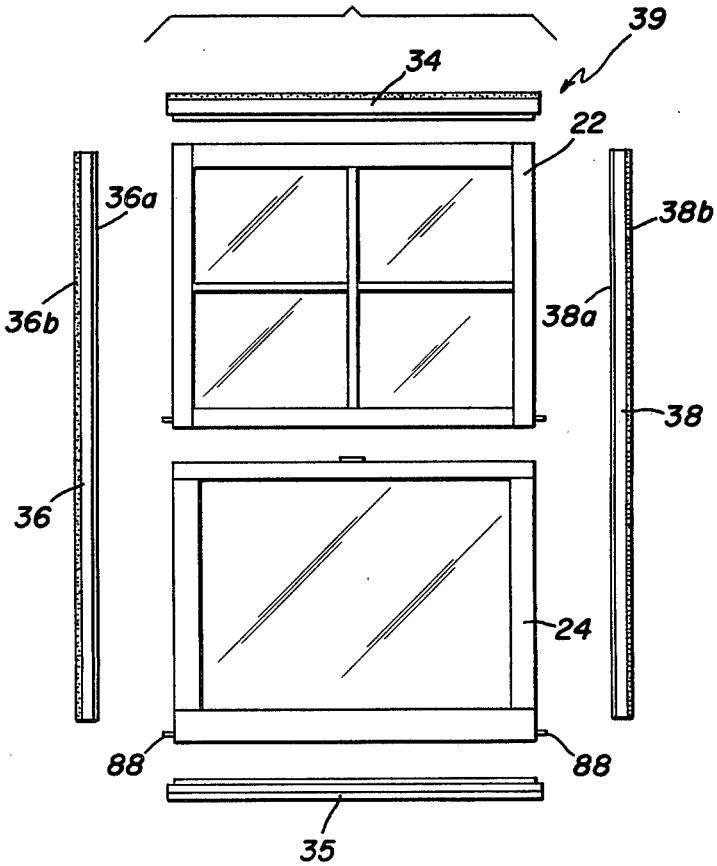
FIG. 19 is an exploded, front elevational view of the various elements which make up the window conversion assembly of the invention, including the headpiece, sill piece, side members, and upper and lower sash windows.

After the headpiece 34 is in place, the sill piece 35 is positioned within the lower portion of the window frame 20, so that the ends of the sill piece 35*a*, 35*b*, abut the side jambs 26 of the frame (see FIGS. 9, 10, 12). The inner end of the sill 28 includes a conventional apron 60 and stool 61. The sill piece 35 is of flat rectangular shape, formed of wood or the like, having upper and lower surfaces 35*c*, 35*d*, respectively, and including an angular rear edge surface 35*e* designed to abut an internal stop 62 carried by the window frame (see FIG. 10). The sill piece 35 is placed upon the frame sill 28, and a bead 64 of the caulk is placed under the front of the sill piece. The sill piece 35 is then firmly pressed into place and nailed onto the frame sill 28.

In keeping with the invention, the upper surface 35*c* of the sill piece is provided with a vertical slot or groove 65 disposed for mounting a specially shaped weather-strip 66 adapted to be received in an open horizontal slot 68 provided along the bottom surface of the outer rail 24*a* of the new lower window sash 24 (see FIG. 8). The weather-strip 66 includes shank 69 and tongue 70 portions. The shank 69 carries an annular flange 71 sized and shaped so that when it is inserted into the slot 68, the shank fits against one side of the slot and the flange is compressed against the other side of the slot, thus forming a tight friction fit of the shank within the slot. The weather-strip tongue 70 is designed to be compressed in a similar friction fit into the lower window slot 68. Thus, when the lower window sash 24 is in its lowermost position, the weather-strip 66 completely seals the entire length of the horizontal juncture between the lower sash 24 and the sill piece 35, so that no cold or warm air may pass between them. If desired, the sill piece 35 may be shimmed as desired to assist in accommodating an out-of-square window frame.

As shown in FIG. 8, the slot 65 is provided in the sill piece has a width x', which may be about ⅛ inch in practice. The lower window slot 68 is V-shaped to facilitate entry therein of the weather-strip tongue 70, having a width w' near the bottom where the compressed tongue engages the inner sides of the slot, and a height h'. Due to the V-shape, the width of the slot 68 along the lower horizontal surface of the lower window sash 24 is somewhat larger than the width w' near the slot bottom. Preferably, the width of the opening of the slot 68 along the lower surface of the window sash 24 is about 1.6 times greater than w' (to accommodate the slight bevel of the sill 28), and the slot height h' is about 3 to 4 times as large as w'. In practice, w' may be about ⅛ inch. As in the case of the upper sash, a high leaf type weather-strip 66 with an open tongue or flap 70 may be employed with the lower sash which, when compressed within the slot 68, assures maintenance of sealing contact between the lower sash 24 and the sill piece 35 even where an extreme out-of-square condition is found to exist in the old window frame.

Figure 11:
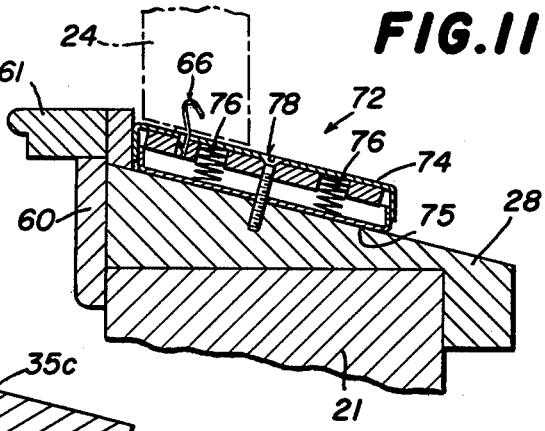
FIG. 11 is a fragmentary cross-sectional view, like FIG. 10 but reduced in size, illustrating an alternative form of sill piece which may be used with the invention.

As described, the preferred form of the invention involves use of an adjustable headpiece 34 in combination with a fixed sill piece 35, with the headpiece adjustment feature accommodating any out-of-squareness of the window frame 20. An alternative form of the invention is illustrated in FIG. 11. In this alternative, the resilience feature is provided within the sill member 72. The illustrative sill member 72 is of generally flat, rectangular configuration, but in this instance takes the form of a spring box having upper 74 and lower 75 portions which are relatively movable. A plurality of spaced vertically disposed coil springs 76 within the box are interposed between the upper and lower box portions to urge them apart, with the limit of movement being provided by one or more fasteners 78 which secure the sill member 72 to the window sill 28. Importantly, the weather-stripping arrangement shown in FIG. 10 (see reference characters 65 through 71) is also utilized in the FIG. 11 embodiment of the invention. The sill member 72 of FIG. 11 may be utilized in conjunction with the resilient headpiece 34 previously described, or with a similar headpiece not including the resilience feature (i.e., without the plastic foam pieces 44) since the resilience feature is included in the sill member 72.

The next step in assembly of the new window is to install the side members 36, 38, which in this instance take the form of jamb balances or jamb channels, within the side jambs 26 of the window frame 20. This is done by first affixing a plurality of mounting clips 79 at vertically spaced intervals along each of the side jamb 26 of the window frame (see FIGS. 13–18). In the illustrative form of the invention, the mounting clips 79 are formed of metal and may be affixed to the window frame using nails or other suitable fasteners 80. The illustrative channel balances 36, 38 are of generally flat, rectangular configuration, having inner 36*a*, 38*a*, and outer 36*b*, 38*b* surfaces. The members 36, 38 may be formed of molded or extruded plastic or metal. Their inner surfaces 36*a*, 38*a* are provided with a pair of spaced grooves or channels 81, 82 which serve as tracks for up and down movement of the window sashes 22, 24. Coil springs 84 are mounted in the upper portions of each of the tracks with the upper ends of the springs being affixed to the track itself, and the lower ends secured to balance shoes 85 for connection to the upper and lower window sashes. The balance shoes 85 are provided with openings 86 for receiving mounting pins 88 carried by the upper and lower window sashes 22, 24. A foam plastic meeting rail pad 89 is mounted between the window tracks 81,82 for sealing the ends of the longitudinal joint between the upper and lower sashes 22, 24.

The outer surface 36i b, 38*b* of each channel balance is provided with one or more strips 90 of resilient foam plastic to facilitate resilient and adjustable mounting of the channel balance against the inside of the window frame 20. Thus, after the channel balances 36, 38 are in place within the window frame 20, the mounting pins 88 of the upper and lower window sashes 22, 24 ride in the tracks 81, 82.

For the purpose of facilitating mounting of the channel balances 36, 38 against the side of the window frame 20, the outer surfaces 36*b*, 38*b* of the channel balances are provided with a pair of laterally spaced retaining lips 91 disposed for locking engagement with cooperating legs 92 carried by the mounting clips 79. Thus, after the mounting clips 79 are in place on the window frame 20, one of the channel balances 36, 38 is placed along one of the frame side jambs 26 and is pressed against the clips. This causes the clip legs 92 to accept and snap over the retaining lips 91 carried by the channel balance, to thereby secure the channel balance tightly against the window frame. The same procedure is then followed with the other side member.

A conventional meeting rail construction is provided between upper and lower sash windows 22, 24. Thus, as illustrated (see FIG. 8), the upper window sash includes a specially shaped top check rail 22*b*. Similarly, the lower window sash 24 has a complementally shaped bottom check rail 24*b*. An L-shaped slot 94 is defined by the check rails 22*b*, 24*b* when the upper and lower sashes 22, 24 are in their fully closed position. Disposed within this L-shaped slot is a similarly shaped weather-strip 95 generally like the weather-strip 56 described previously (see FIG. 5). This weather-strip arrangement 94, 95 thus protects the weatherability of the joint between the upper and lower sashes 22, 24.

Installation of the upper and lower window sashes 22, 24 is carried out as follows. First, the upper sash 22 is located in the upper portion of the window frame and is held at an angle between the channel balances 36, 38 so that one mounting pin 88 is slipped into the opening 86 in the corresponding balance shoe 85 carried by the channel balance. Then, the upper sash is pushed down, still being maintained at the angle at which the sash is held, until the mounting pin 88 on the opposite side of the sash is alined for entry into the other balance shoe opening 86. The ready lateral compressibility of the channel balances 36, 38, due to the action of their resilient strips 90, enables the window sashes 22, 24 to be tilted within the new window frame as necessary. Finally, by bringing the sash level by pushing down on the second side, the second connecting pin 88 enters the opening 86 easily, and the upper window sash is installed. The same procedure is repeated with the bottom sash.

When the new window assembly is complete, with the upper and lower sashes 22, 24 in place, the window is fully weatherproofed, i.e., weather-stripping is provided on the horizontal juncture between the upper sash and the headpiece, on the horizontal juncture between the sill piece and the lower sash, and along the horizontal juncture between the upper and lower sashes. The invention is particularly efficacious in its provision of this full perimeter weather-stripping feature. As will be readily apparent, a double-hung window presents eight corners, and two window planes where leakage of hot or cold air may occur. Through use of the invention, a window assembly is provided which positively seals all of the corners and both planes, so that the complete window assembly provides full protection against the weather. While use in the illustrative window sashes 22, 24 of insulated (double strength) glass is preferred, the invention may also be employed using single strength glass as for example where a storm window is in place.

Another of the advantageous features of the invention is that the specially shaped weather-strips 56, 66 are of a high leaf design having their tongue portions elongated so as to extend an appreciable distance into the outer rails 22*a*, 24*a* of the window sashes. This arrangement assures a positive sealing contact between the window sashes and the window frame even in situations where extreme skewing of the window may result from out-of-squareness of the frame.

Still another feature of the invention is that a window assembly is provided which includes side members which may be readily installed along the inside of an old window frame, i.e., using the simple clip arrangement described herein, yet which provide a positive seal between the window sashes and frame.

A further advantageous feature of the invention is that an old window may be replaced by a single person, using just a few ordinary tools and the like. Thus, in most instances, the only tools and materials required are a screwdriver, a putty knife, a hammer, and a tube of caulking material. Another advantage of the invention is that an old window may be replacing using the invention by a person working entirely on the inside of a building, without the need to remove an outer storm window, making the invention highly useful even in inclement weather.

Certain preferred structures in accordance with the invention have been described and illustrated. It will be apparent to those skilled in the art that various changes and modifications may be made therein within the spirit and scope of the invention. It is intended that such changes and modifications be included within the scope of the appended claims.

I claim as my invention:

1. A kit for converting an old double-hung window assembly, including a frame having a head jamb, opposed side jambs, and a bottom sill, to a new double-hung window assembly having full perimeter weather-stripping, comprising, in combination, a headpiece for mounting against the underside of the old window frame head jamb, a sill piece for mounting against the upperside of the old window frame bottom sill, means for mounting said headpiece resiliently so as to accommodate any out-of-squareness of the old window frame, a pair of side members for resilient mounting against the respective opposed side jambs of the old window frame, a double-hung window for mounting within the assembled headpiece, sill piece, and side members to thereby form a complete window assembly, said headpiece including a vertical groove coextensive in length with the width of the upper window sash and the window including a vertical slot in its outer rail coextensive in length and generally vertically alined with the headpiece groove, first weather-stripping means disposed between the upper window sash and the assembled headpiece and including shank and tongue portions with the shank portion mounted in said headpiece groove and the torque portion extending into said window slot when the window assembly is complete, said sill piece including a vertical slot coextensive in length with the width of the lower window sash and the window including a vertical slot in its outer rail coextensive in length and generally vertically alined with the sill piece groove, and second weather-stripping means disposed between the lower window sash and the assembled sill piece and including shank and tongue portions with the shank portion mounted in said sill piece groove and the tongue portion extending into said window slot when the window assembly is complete, third weather-stripping means provided between the upper and lower window sashes, fourth weather-stripping means disposed between the window sashes and each of said side members, and said headpiece mounting means including a pair of parallel, spaced resilient plastic foam pieces interposed between the headpiece and the underside of the old window frame head jamb.

2. The window conversion kit defined in claim 1 in which each of the window slots is V-shaped and has a height about 3 to 4 times greater than its width.

3. The window conversion kit defined in claim 1 in which the assembled sill piece is resiliently mounted to the frame bottom sill.

* * * * *